United States Patent [19]

Hälker et al.

[11] Patent Number: 4,761,329

[45] Date of Patent: Aug. 2, 1988

[54] MACHINE FELT, AND A METHOD FOR MANUFACTURING SAME

[75] Inventors: Vera Hälker; Helmut Hälker, both of Niederzier, Fed. Rep. of Germany

[73] Assignee: Thomas Josef Heimbach GmbH & Co., Düren, Fed. Rep. of Germany

[21] Appl. No.: 100,178

[22] Filed: Sep. 23, 1987

[30] Foreign Application Priority Data

Sep. 24, 1986 [DE] Fed. Rep. of Germany ..... 3632386

[51] Int. Cl.[4] ..... D03D 13/00

[52] U.S. Cl. ..... 428/222; 139/383 A; 162/358; 162/DIG. 1; 428/121; 428/192; 428/193; 428/225; 428/253; 428/257

[58] Field of Search ..... 162/358, DIG. 1; 139/383 AA; 428/253, 222, 192, 193, 121, 225, 257

[56] References Cited

U.S. PATENT DOCUMENTS 4,695,498 9/1987 Sarrazun et al. ..... 428/257

*Primary Examiner*—James J. Bell

*Attorney, Agent, or Firm*—Shlesinger, Arkwright & Garvey

[57] ABSTRACT

The invention concerns a machine felt, in particular a papermaking machine felt, having the following features:

(a) the machine felt comprises a support material extending over its entire length, (b) the support material is in several plies over it entire extent, (c) the individual plies consists of at least one belt of material, in particular a knit fabric, (d) the belt of material, or at least one of the belts of material, exceeds the size of the machine felt and overlaps itself forming at least two complete plies, (e) the plies of the support material are connected by at least one pinned web.

18 Claims, 1 Drawing Sheet

MACHINE FELT, AND A METHOD FOR MANUFACTURING SAME

Machine felts have the most diverse applications. A main field of application is in papermaking machines. Therein they are used in particular in the press stage. Ordinarily they consist of a support material which most of all absorbs the tensions exerted on the machine felt, further of a fiber web pinned on the support material and assuring a smooth and soft surface and a specific water permeability. Frequently the support material is designed to be of several plies. If, as is the cast most often, the support material consist of a fabric, several planes of filling threads bound together by warp threads, or several plies of completed belts of fabric coupled by binding threads, can be used to build several plies.

Various solutions are known to join the tip edges of the machine felts. One solution is to make the entire machine felt oversize, whereby short projections exist at both end segments, which then are bent around on the back side of the machine felt (European patent application No. 0099 836). A number of filling threads have been removed in the zone of the fold-over edge, whereby loops consisting of warp threads are formed. The loops of both tip edges are then made to overlap and a slip-in wire can be passed through them. However special connecting means such as spirals or the like, may be provided, that then are inserted into the warp loops.

This kind of connection suffers from the drawback that in the seam zone, the machine felt is twice as thick as elsewhere, and thereby substantial vibrations are incurred. Such a connection moreover is unsuitable for a support material made of knits.

The German Offenlegunsschrift No. 24 36 293 describes papermaking machine felts with a warp-knit structure as the support material. The warp-knit is provided with a pinned or needled fiber web whereby a felt-like surface is produced on both sides.

The connection of the ends of the felt band of the papermaking machine presents problems because the structure of the warp-knit offers only a slight grip at its ends to the coupling elements for instance in the form of spirals, even when the support material is in several plies. Suggestions already have been advanced in the German Gebrauchsmuster No. 85 10 220.2, one alternative being that the support material consist of a double-ply, spirally/wound belt of material. Thereby the impact between the ends of a belt or length of material will be widely accommodated, namely by changing the position of the belt of material inside out and vice versa. Advantageously the direct connection between the ends of the belt of material can then be eliminated.

However this manufacturing advantage in turn entails drawbacks when mounting the felt into the papermaking machine because the machine felt cannot be opened. Moreover the ply ends cause strong vibrations.

Accordingly it is the object of this invention to so design a machine felt with several plies of the kind stated initially that on one hand vibrations will be averted in the machine even at high operational speeds, while on the other hand this felt can be opened for installation and lastly allows using also knitted support material.

This problem is solved by the invention by means of the following features:

(f) the end zone of the particular belt(s) of material are folded back on the interposed, central segment extending over the entire machine felt of this or these belt(s) of material in order to form the plies formed by overlapping, (g) the folded-back edge or at least one of the folded-back edges can be connected together on each tip side of the machine felt.

In the invention therefore the plies of the support material are formed in that both end segments of the belt of material made in excess length are folded back to such an extent on the central zone that at least two plies are formed. The folding edges then are so far from the folded back tip edges of the belt material that coupling elements can be fastened to the folding edges, even when illustratively the particular belt of material is not woven but instead consists of a warp-knit. In this manner a finite machine felt is achieved, of which the tip edges consisting of the folding edges are joined by the connecting elements or,—if the connection is opened following the pinning of the fiber web—are linkable. In the latter case the machine felt can be placed in its open condition into the machine and must be closed only then. This design furthermore eliminates machine vibrations. Furthermore the machine felt of the invention is characterized by improved tensile strength.

As a rule it is enough that the individual plies are formed by folding over the end segments of a single belt of material. However it is possible also to form the support material from two or even more superposed belts of material each with folded-back end segments. These belts of material can be merely superposed or they may nestle into one another, the first alternative offering the advantage that the plies of the outer belt of material is made of a finer weave or knit than the inner belt of material in order to avoid markings.

In a further embodiment of the invention, the folded-back end segments of the belt of material are mutually opposite by their tip edges and, for reasons of symmetry, in such a manner that they are located at the center of the machine felt, whereby the folded-back end segments therefore are of the same length. The tip edges of the folded-back end segments may extend precisely transversely to the direction of advance of the machine felt. Preferably however the tip edges shall be at a slant to the transverse direction of the machine felt, in particular if the machine felt is being used in the pressing stage of a papermaking machine. As a result any vibrations or impacts still present in the press shall be avoided.

A three-ply support material is obtained when the folded-back end segments of the belt of material overlap over the entire length of the machine felt. If the support material is formed of more than one belt of material, then upon a corresponding combination of these belts, support materials with four, five and six plies can be manufactured.

Appropriately the end segments of the belt of material are folded back toward the same side even where it is possible to fold over the end segments once to one side and next to the other.

Suitable connecting elements in particular are spirals inserted into the support material which upon the joining of the machine felt are made to engage in such a manner that a slip-in wire can be inserted into both simultaneously which shall couple the two spirals. Polyamide was found especially suitable for the spirals. A non-run warp-knit was found especially suitable for the machine felt of the invention.

In order that the folded-back end segments stay in their positions when the fiber web is being pinned, the tip edges of the end segments shall be temporarily fastened to the adjacent ply and/or to each other.

A method for manufacturing the machine felt of the invention is characterized in that both end segments of the belt of material are folded back and are guided by means of their tip edges at least to the same height and that before or after the folding-over operation coupling elements are fastened in the zone of the folding edges and in that thereupon the coupling elements are joined while forming a seam before the fiber web is deposited and pinned. In case the machine felt must be introduced into the machine in the open condition, the fiber web following pinning shall be slit open on one side of the seam at the top and at the bottom sides to be lifted off the seam zone, whereupon the seam shall be opened again.

This method is characterized by simplicity and furthermore by the fact that by pinning the fiber web in the manner described, the seam also shall be covered softly even though subsequently the seam can be opened and closed again. The lifted part of the fiber web then will come to rest again in operation over the seam, the direction of advance always to be so selected that the slit is located behind the seam.

To carry out the method of the invention, the tip edges of the end segments shall be provisorily fastened in place. Also, the spirals used as coupling elements shall be inserted during the manufacture of the support material: this is possible in simple manner in particular where knits are concerned.

The invention further provides that the tip edges of the end segments are controlled to be overlapping up to the folding edges to achieve a triple-ply design of the belt of material.

Lastly the invention proposes that a warp-knit be used for the support material, where the end segments of this warp-knit are so folded back that he cross-threads of one ply shall be offset from and facing the gaps of the cross-threads of the other ply. This offers the advantage that upon compressing the machine felt, the cross-threads shall positively mesh into each other and shall in this manner reinforce one another so that the plies shall not move relative to each other.

The invention is shown in further detail in the drawing in relation to illustrative embodiments.

Figure 1:
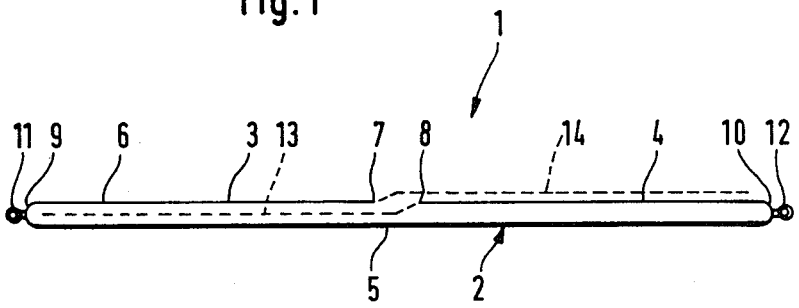
FIG. 1 is a sideview of a support material for a machine felt.
Figure 2:
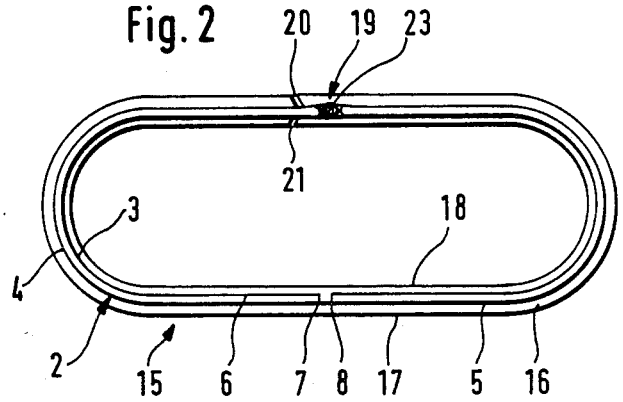
FIG. 2 is the sideview of a papermaking machine felt with the support material of FIG. 1.

The support material 1 shown in FIG. 1 consists of a single belt of material 2. The belt of material 2 is about twice as long as the finished papermaking machine felt shown in FIG. 2. By folding back the two end segments 3,4 in such a way that they come to rest on the central zone 5 and hence on the lower ply, a further and upper ply 6 is formed with mutually opposite tip edges 7,8. Spirals are inserted into the belt of material 2 at the folding edges 9,10 and across their entire lengths: this is carried out already during the manufacturing process.

A three-ply variation of the support material 1 is shown by the dashed extensions 13 14: if the belt of material 2 is made in a length which is triple that of the papermaking machine felt, the end segments 3,4 will then completely overlap with the then present extensions 13, 14, one end segment 3 coming to rest on the outside and one end segment 4 on the inside.

During the further processing into a papermaking machine felt, the support material 1 is closed into an endless belt by the two spirals 11, 12—which match their thickness to that of the support material 1—so meshing together that a slip-in wire can pass through them as a connection wire. Thereupon a fiber web is pinned on and through the outside of the support material 1. This pining or needling then produces the papermaking machine felt 15 shown in FIG. 2, the size of the fiber web 16 being shown—even though exaggerated relative to the length and width of the papermaking machine felt 15—by the boundary lines 17, 18.

In order to release the connection of the folding lines 9,10 the slip-in wire 23 is removed and the fiber web 16 is provided with slits 20, 21 above and below the spirals 11, 12.

Thereupon the papermaking machine felt 15 may be inserted into a papermaking machine and after the ends equipped with the spirals 11, 12 are joined, can be coupled again by inserting the slip-in wire 23.

Thereupon the loose ends of the fiber web 16 will lie flat over the seam 19.

We claim:

1. A machine felt, in particular for papermaking machines, having the following features:

(a) the machine felt is provided with a support material extending over its entire length, (b) the support material is in several plies over its entire extent, (c) the individual plies consist of at least one belt of material, in particular a knit, (d) the belt of material or at least one of the belts of material exceeds the length of the machine felt and overlaps itself while forming at least two complete plies, (e) the plies of the support material are joined by at least one pinned fiber web, characterized by the following features:

(f) in order to form the plies (5,6) due to overlapping, the end segments (3,4) of the particular belt(s) of material (2) are folded back on the in-between, central segment (5) of these belt(s) of material (2) covering the entire machine felt (1), (g) the, or at least one of the folding edges (9,10) on each tip side of the machine felt (1) can be joined together by coupling elements (11, 12).

2. Machine felt defined in claim 1, characterized in that the support material (1) consists of two or more superposed belts of material with folded back end segments.

3. Machine felt defined by claim 1, characterized in that at least two belts of material are superposed, the outer belt of material being of a finer support material than the inner belt(s) of material.

4. Machine felt defined by claim 1, characterized in that the folded-back end segments (3,4) of the belt material are mutually opposite by their tip edges (7,8).

5. Machine felt defined in claim 1, characterized in that the folded-back end segments (3,4) have the same length.

6. Machine felt defined by claim 1, characterized in that the tip edges slant relative to the transverse direction of the machine felt.

7. Machine felt defined by claim 1, characterized in that the folded-back end segments (3,4 13,14) of the belt of material (2) are of such lengths that they overlap themselves over the entire length of the machine felt (15).

8. Machine felt defined in claim 1, characterized in that the end segments (3,4) of the belt of material (2) are folded back toward the same side.

9. Machine felt defined by claim 1, characterized in that the coupling elements are designed to be spirals (11, 12) inserted into the support material (1).

10. Machine felt defined in claim 9, characterized in that the spirals (11, 12) are made of polyamide.

11. Machine felt defined by claim 1, characterized in that the support material (1) consists of a non-run warp-knit.

12. Machine felt defined by claim 1, characterized in that the tip edges (7,8) of the folded-back end segments (3,4) are temporarily fastened to the adjacent ply (5) and/or to each other.

13. A method for manufacturing a machine felt defined in claim 1, wherein a support material consisting of at least one belt of material is superposed into at least two plies, whereupon a fiber web is deposited and is pinned together with the plies, in that both end segments (3,4) of the belt of material (2) are folded back and are moved together by their tip edges (7,8) at least to the same level and in that before or after the folding-back procedure coupling elements (11, 12) are fastened in the vicinity of the folding edges (9,10) and in that thereupon the coupling elements (11,12) are connected together while forming a seam (19) before the fiber web (17) is deposited and pinned.

14. Method defined in claim 13, characterized in that following the pinning procedure the fiber web is slit on one side of the seam (19) at the top and at the lower side and is lifted off the seam zone (19) and in that the seam (19) then is reopened.

15. Method defined by claim 13, characterized in that the tip sides (7,8) of the end segments (3,4) are temporarily fastened.

16. Method defined in claim 13, characterized in that the coupling elements are inserted as spirals (11, 12) into the coupling elements during the manufacture of the support material (1).

17. Method defined by claim 13, characterized in that the tip sides (7,8) of the end segments (3, 4, 13, 14) are guided in overlapping manner as far as the folding edges (9, 10).

18. Method defined in claim 13, characterized in that a warp-knit is used for the support material, the end segments (3,4) of said warp-knit being folded back in such a manner that the cross-threads of one ply are offset relative to and opposite the gaps of the cross-threads of the other ply.

* * * * *